US012714221B2

(12) United States Patent
Chevalier et al.

(10) Patent No.: US 12,714,221 B2
(45) Date of Patent: Aug. 25, 2026

(54) MASCARA BRUSH

(71) Applicant: LVMH RECHERCHE, Saint-Jean-de-Braye (FR)

(72) Inventors: Marc Chevalier, Saint-Jean-de-Braye (FR); Yohann Bichon, Saint-Jean-de-Braye (FR)

(73) Assignee: LVMH RECHERCHE, Saint-Jean-de-Braye (FR)

( * ) Notice: Subject to any disclaimer, the term of this patent is extended or adjusted under 35 U.S.C. 154(b) by 107 days.

(21) Appl. No.: 18/713,796

(22) PCT Filed: Nov. 22, 2022

(86) PCT No.: PCT/FR2022/052154
§ 371 (c)(1),
(2) Date: May 28, 2024

(87) PCT Pub. No.: WO2023/094762
PCT Pub. Date: Jun. 1, 2023

(65) Prior Publication Data

US 2025/0017360 A1 Jan. 16, 2025

(30) Foreign Application Priority Data

Nov. 26, 2021 (FR) ..... 2112583

(51) Int. Cl.
*A46B 9/02* (2006.01)

(52) U.S. Cl.
CPC ..... *A46B 9/021* (2013.01); *A46B 9/026* (2013.01); *A46B 2200/1053* (2013.01)

(58) Field of Classification Search
CPC .. A46B 9/021; A46B 9/026; A46B 2200/1053
See application file for complete search history.

(56) References Cited

U.S. PATENT DOCUMENTS

| | | | | |
|---|---|---|---|---|
| D682,556 | S * | 5/2013 | Uresti | A46B 9/021 D4/128 |
| 2015/0272301 | A1* | 10/2015 | Schreiber | A45D 40/265 401/129 |
| 2015/0366325 | A1 | 12/2015 | Wolfsgruber | |
| 2017/0258216 | A1* | 9/2017 | Chant | A46B 9/026 |
| 2017/0311700 | A1* | 11/2017 | Berhault | A46B 3/005 |
| 2018/0000228 | A1* | 1/2018 | Crapet | A46B 9/026 |
| 2018/0220785 | A1* | 8/2018 | De Bardonneche | A46B 9/021 |

(Continued)

FOREIGN PATENT DOCUMENTS

| | | | |
|---|---|---|---|
| FR | 2969470 | A1 | 6/2012 |
| FR | 3044529 | A1 | 6/2017 |
| WO | 2018130371 | A1 | 7/2018 |

OTHER PUBLICATIONS

International Search Report for PCT/FR2022/052154, dated Jan. 6, 2023, 4 pages.

*Primary Examiner* — Nicholas D Lucchesi
(74) *Attorney, Agent, or Firm* — Lippes Mathias LLP

(57) ABSTRACT

A mascara brush extending along a main axis and having at least one branch equipped with applicator elements. At least one branch includes a primary branch having an inner blade an outer blade meeting in such a way as to form a closed loop, and the inner blade is located at a distance from the main axis which is non-zero and less than a distance from the outer blade to the main axis.

17 Claims, 4 Drawing Sheets

(56) References Cited

U.S. PATENT DOCUMENTS

| | | | | |
|---|---|---|---|---|
| 2019/0014895 | A1* | 1/2019 | De Bardonneche | A45D 40/264 |
| 2019/0254407 | A1* | 8/2019 | Scalciarini | A46B 9/021 |
| 2020/0237086 | A1* | 7/2020 | Crapet | A46B 5/0033 |
| 2021/0186183 | A1* | 6/2021 | Crapet | A46B 9/005 |
| 2023/0022223 | A1* | 1/2023 | Castex | A46B 9/021 |
| 2023/0263295 | A1* | 8/2023 | Castex | B29C 64/153 132/218 |
| 2024/0081520 | A1* | 3/2024 | Jacob | A46B 9/026 |
| 2024/0180320 | A1* | 6/2024 | Von Jan | A45D 40/262 |

* cited by examiner

[Fig. 1]
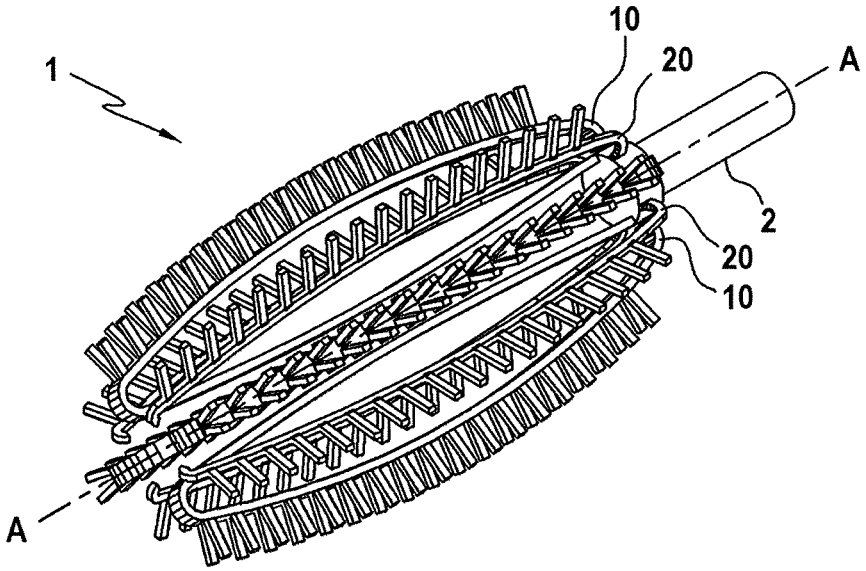
[Fig. 2]
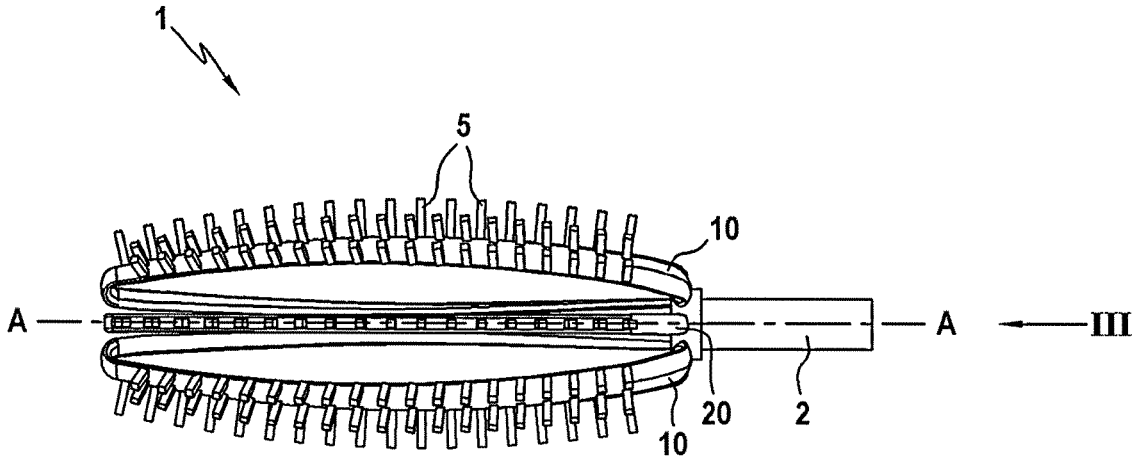

[Fig.3]
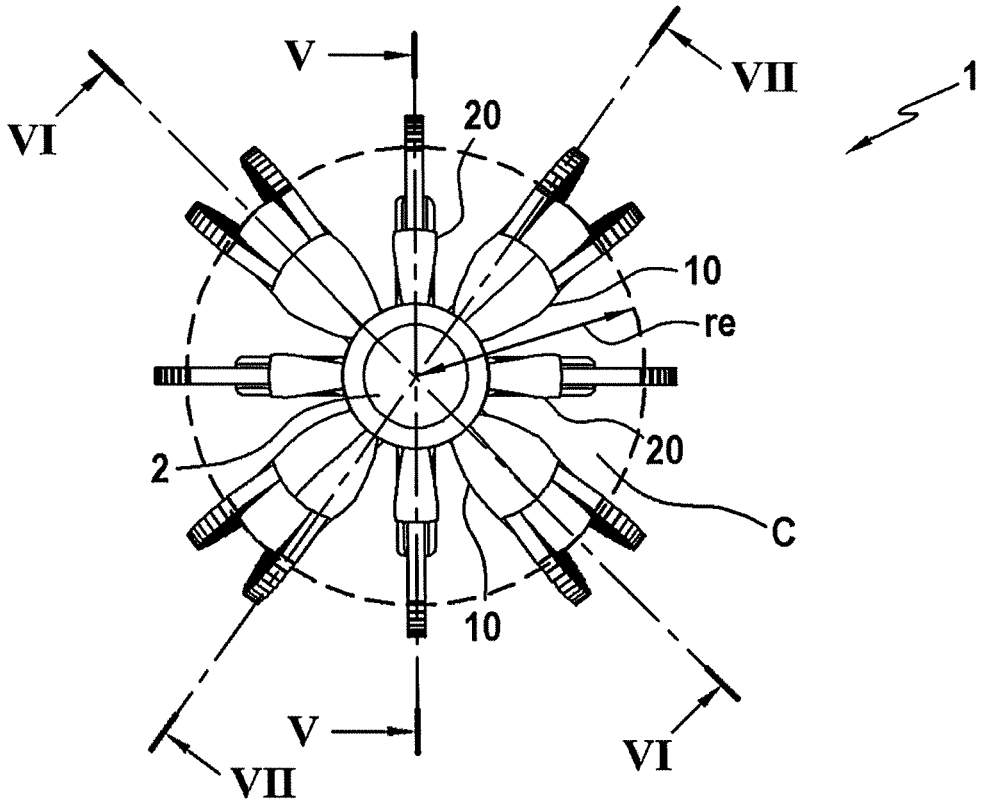
[Fig.4]
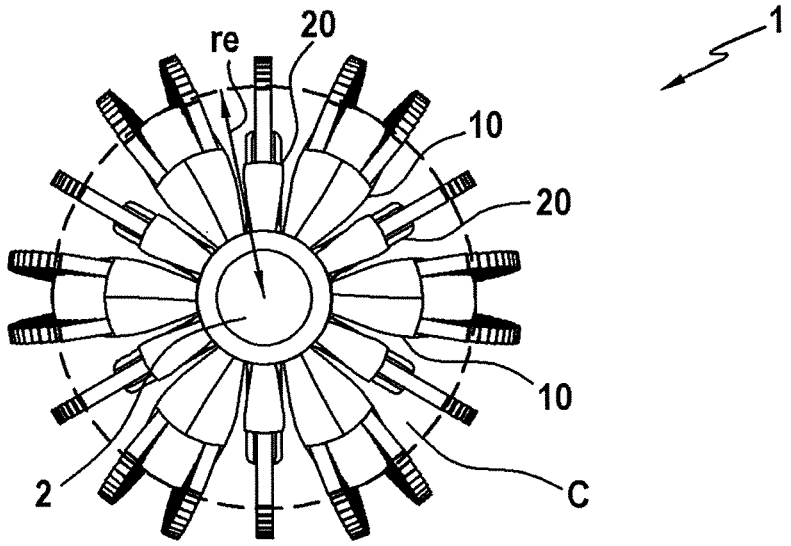

[Fig.5]
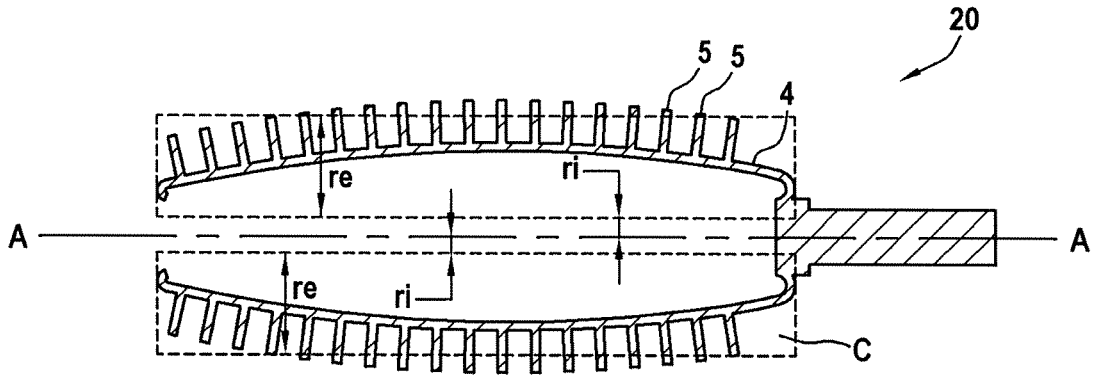
[Fig.6]
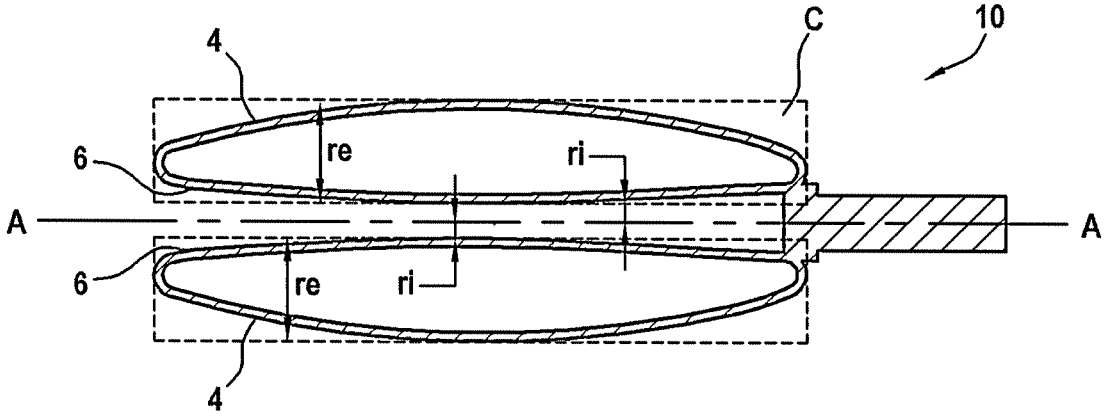
[Fig. 7]
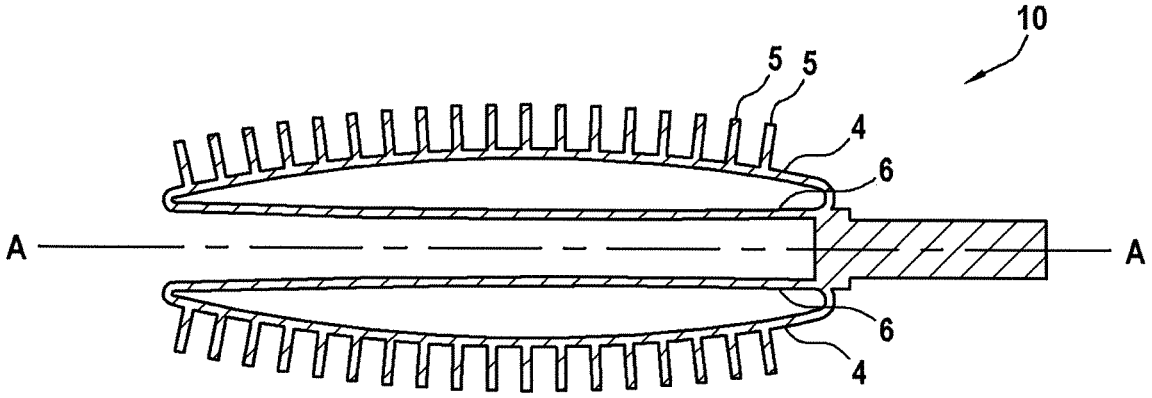

[Fig. 8]
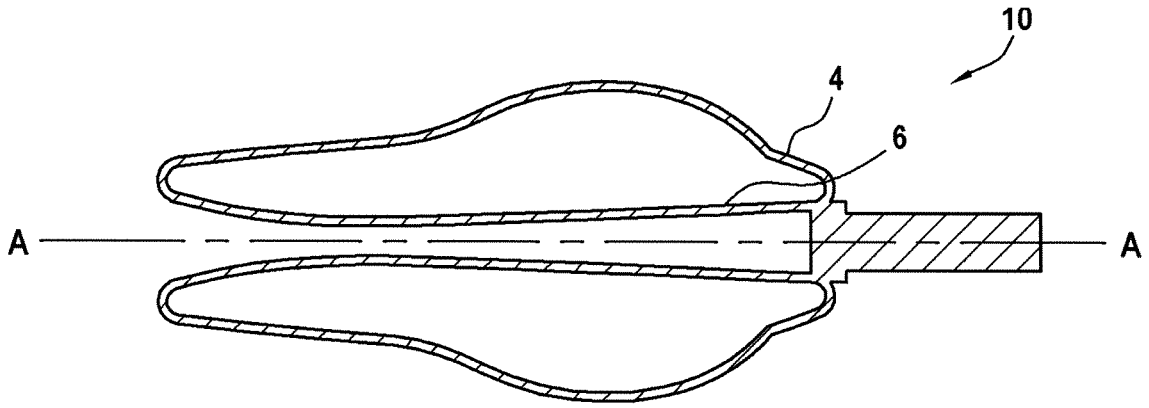
[Fig. 9]
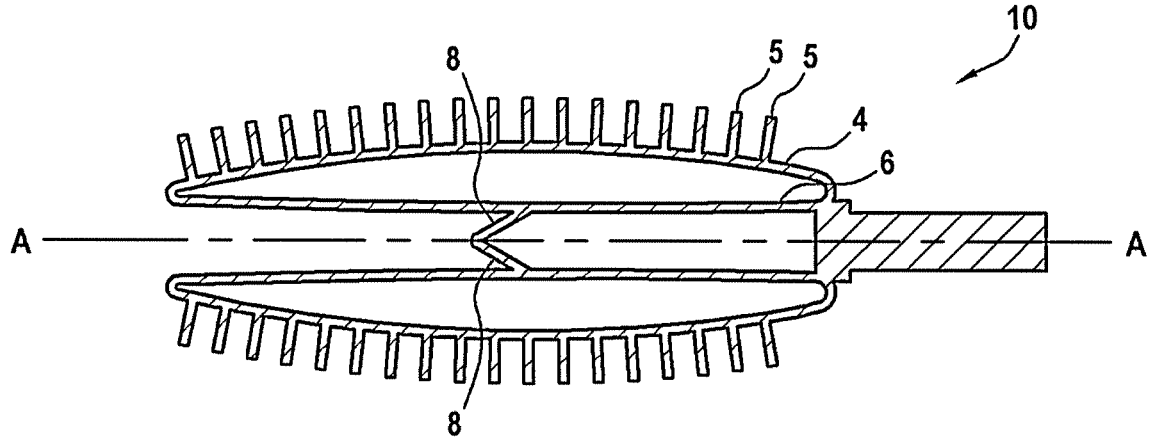
[Fig. 10]
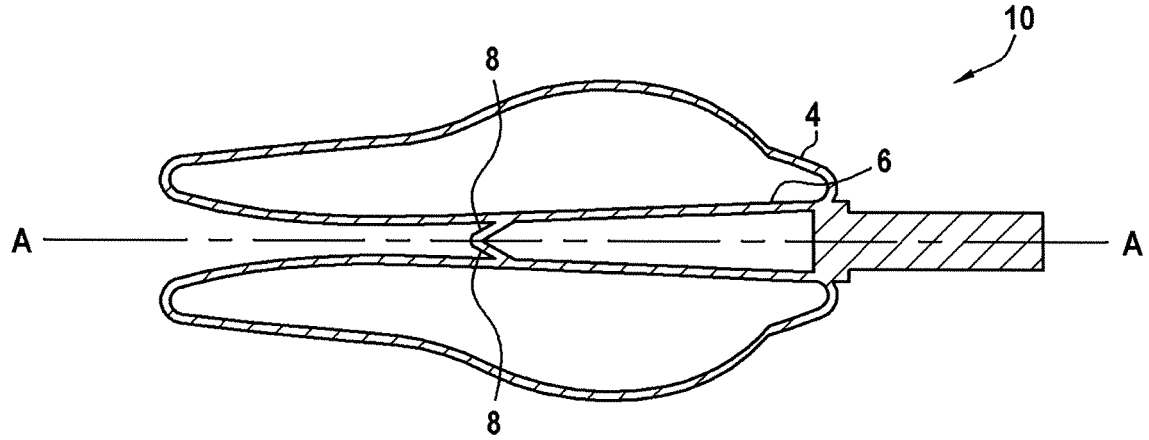

MASCARA BRUSH

BACKGROUND OF THE DISCLOSURE

This summary relates to a mascara brush, and more specifically a structure of a mascara brush. Such a mascara brush can in particular have an application in the field of cosmetics.

STATE OF THE ART

A mascara brush is used to collect a formula contained in a bottle, then apply it to the eyelashes of a user.

To simplify the use of a mascara brush, it would be advantageous to be able to provide a mascara brush allowing better application of formula to the eyelashes.

SUMMARY OF THE DISCLOSURE

For this purpose, this summary relates to a mascara brush extending along a main axis and comprising at least one branch equipped with applicator elements, wherein

- the at least one branch comprises a primary branch having an inner blade and an outer blade meeting in such a way as to form a closed loop, and
- the inner blade is located at a distance from the main axis which is non-zero and less than a distance from the outer blade to the main axis.

In this summary, the term "main axis" refers to the main axis of the brush. The axial direction is equivalent to the direction of the main axis and a radial direction is a direction perpendicular to this axis and intersecting this axis. Similarly, an axial plane is a plane containing the main axis and a radial plane is a plane perpendicular to this axis. A circumference extends as a circle belonging to a radial plane and the center of which belongs to the axis of the distributor. A tangential or circumferential direction is a direction tangent to a circumference; it is perpendicular to the axis but does not pass through the axis. A circumferential plane is a plane strictly parallel to the axis, i.e. not intersecting the axis and not containing the axis.

The term "blade" is understood to mean a straight or curved and filiform structure, i.e. having one dimension larger than the two other dimensions. For example, the term "blade" should be understood to mean a solid of which the length, optionally curvilinear, is greater than its thickness and its width.

It will be understood that the meeting of the inner blade and of the outer blade forms a closed loop when two separate ends of the inner blade are respectively connected to two separate ends of the outer blade.

In such a mascara brush, the closed loop structure formed by the inner blade and the outer blade has flexibility, to improve the following of the eyelash when applying the formula. Moreover, due to the distance from the blades to the main axis, a space is free within the brush, this space allowing the accumulation of formula, and thus increasing the quantity of formula that can be deposited in one application. These two effects allow easier application of formula in just one application.

In certain embodiments, the inner blade is located at a distance from the main axis that is strictly positive and less than a distance from the outer blade to the main axis.

In certain embodiments, applicator elements are disposed on the outer blade of the primary branch.

It will be understood that branches, which are not primary branches but which have an outer blade, may have applicator elements disposed on an outer blade.

The applicator elements make it possible to facilitate the application of formula onto individual eyelashes. The applicator elements may be hairs, bristles etc.

In certain embodiments, the inner blade and the outer blade are traversed by one and the same virtual half-plane delimited by the main axis. It is said that a plane traverses a blade if two ends of the blade are in said plane, and that the intersection of the blade with said plane is continuous between these two ends.

The term "virtual plane" is understood to mean a plane not possessing any physical medium. The term "virtual half-plane" is understood to mean a virtual plane half delimited by a straight line.

Owing to such a coplanar position of the inner blade and of the outer blade, the closed loop has a flexibility in a direction corresponding to a direction of application of force during the application of the formula on an eyelash by means of the brush.

In certain embodiments, the loop extends along the main axis over a distance between 10 mm and 45 mm, preferably between 25 mm and 40 mm, preferably 30 mm.

In certain embodiments, the loop of the primary branch is contained in a virtual hollow cylindrical sleeve centered on the main axis and of a thickness between 2 and 10 mm, preferably between 2 mm and 5 mm.

In certain embodiments, the cylindrical sleeve is axisymmetrical, i.e. is a cylindrical sleeve with a circular base.

In certain embodiments, the difference between the distance to the main axis from a position of the loop the furthest from the main axis and the distance to the main axis from a position of the loop closest to the main axis is between 2 and 10 mm, preferably between 2 mm and 5 mm. This difference is equivalent to the radial thickness of the cylindrical sleeve.

In certain embodiments, the primary branch has a convex oblong shape viewed in a circumferential projection.

A circumferential projection is a projection along a circumferential direction in a half-plane limited by the main axis. In other words, points having one and the same circumferential projection are located on one and the same circumference.

The term "oblong" is understood to mean a shape longer than it is large, with non-protruding ends. The shape can have curved and/or polygonal portions interchangeably.

Such a structure makes it possible to adapt the flexibility of the branch, which can deform in an axial plane on the blade spring model.

In certain embodiments, the primary branch has an oblong shape having at least one inflexion point viewed in a circumferential projection.

The term "inflexion point" should be understood to mean a point of change of concavity.

In certain embodiments, the at least one branch has an oblong shape having at least one bulge in a circumferential projection.

In certain embodiments, the inflexion point and/or the bulb are located on the outer branch.

These structures make it possible to locally modify the stiffness of the branches. Moreover, they make it possible to put certain parts of the branches forward or backward, in such a way as to offer the user different areas of application with different properties. These structures make it possible to locally soften or harden the contact with a wringing means on the bottle, in order to locally modify the intensity of wringing of the brush and therefore the quantity of formula locally and globally retained on the brush.

In certain embodiments, the brush comprises a plurality of branches distributed around the main axis.

In certain embodiments, the brush comprises a plurality of identical branches.

In certain embodiments, the brush comprises a plurality of branches evenly distributed around the main axis.

It will be understood that all the branches may be identical to one another. It will also be understood that it is possible for only certain branches to be identical to one another, forming families of branches such that the branches of one and the same family are identical to one another, and the branches of distinct families are distinct.

In certain embodiments, the branches of the plurality of branches are rotationally invariant by a non-zero angle strictly less than 360°. It will be understood that this property is applicable to all the branches, said rotation then converting each branch into another branch which is identical to it. The rotation can be a rotation about the main axis. The rotational invariance allows for comfort of use for the user, who does not have to worry about the orientation of the brush.

In certain embodiments, successive branches of the plurality of branches are of different shapes.

The term "successive branches" should be understood to mean circumferentially successive branches.

In certain embodiments, the branches of the plurality of branches are primary branches having alternately a convex oblong shape viewed in a circumferential projection and an oblong shape having at least one inflexion point viewed in a circumferential projection.

It will be understood that the shapes described in a circumferential projection can in particular be the same shapes viewed in a virtual half-plane delimited by the main axis. However, the branches can where applicable also extend along a circumferential component.

The arrangement of the branches and the diversity of their shapes make it possible to apply formula by means of several different branch patterns of different dimensions and deformability, and thus to ensure better application of the formula.

In certain embodiments, the brush has at least one reinforcement connecting at least two distinct inner blades.

The reinforcement makes it possible to reinforce the structure of the brush, and in particular to reduce its deformability in a radial direction to a local deformation of one branch rather than to an overall deformation of the brush. The reinforcement also forms a join between the inner blades, through which the formula can be distributed between two inner blades of two distinct branches.

In certain embodiments, the at least one reinforcement extends in a direction which is oblique with respect to the main axis.

The term "direction which is oblique with respect to the main axis" should be understood to mean a direction contained in an axial plane and forming an angle with the main axis strictly contained between 0° and 90°.

For example, the reinforcement is a central reinforcement. A position is said to be central near the main axis, and peripheral away from the main axis. Typically, a central reinforcement, can be located closer to the main axis than the inner blades it connects.

In certain embodiments, the reinforcement comprises a plurality of arms respectively connected to the inner blades of primary branches of the plurality of branches, the arms preferably meeting along the main axis.

This summary also relates to a mascara applicator comprising a brush according to this summary, along with a support connected to the brush and configured to be assembled on a stick.

In certain embodiments, an end of the loop opposite the support is a free end.

In certain embodiments, the inner blade and the outer blade meet at the free end of the loop.

The invention also relates to a process for manufacturing a mascara brush according to this summary, comprising at least one step of manufacturing an inner blade and/or an outer blade by an additive manufacturing method.

BRIEF DESCRIPTION OF THE DRAWINGS

FIG. 1 is a perspective view of a brush according to a first embodiment.

FIG. 2 is a view of the brush according to the first embodiment viewed along a lateral directions perspective to the axis of the brush.

FIG. 3 is a view of the brush according to the first embodiment viewed from one end, along direction III of FIG. 2.

FIG. 4 is a view corresponding to the view of FIG. 3 of a brush according to a second embodiment.

FIG. 5 is a view along the section plane V of FIG. 3.

FIG. 6 is a view along the section plane VI of FIG. 3.

FIG. 7 is a view along the section plane VII FIG. 3.

FIG. 8 is a view of an alternative structure to FIGS. 5,6 and 7.

FIG. 9 is a view of a alternative structure to FIGS. 5,6 and 7.

FIG. 10 is a view of a alternative structure to FIGS. 5,6 and 7.

DETAILED DESCRIPTION OF THE PREFERRED EMBODIMENTS

This invention will be described with reference to specific exemplary embodiments. However, it is obvious that modifications and changes can be made to these examples without departing from the general scope of the invention as defined by the claims. In particular, individual features of the different embodiments illustrated/mentioned can be combined into additional embodiments. Consequently, the description and drawings must be considered in an illustrative sense rather than a restrictive one.

The general structure of the brush will be described in relation to FIGS. 1 to 3.

Brush 1 has a structure extending substantially along a main axis A.

One end of the brush 1 is free, and is equivalent to an end by which the brush enters a bottle to collect formula. Another end is connected to a support 2, which can be assembled on a stick in such a way as to form a mascara applicator.

The brush 1 comprises at least one branch, here a plurality of distinct primary 10 and secondary 20 branches, each equipped with applicator elements 5. As explained previously, the primary branches 10 and the secondary branches 20 can have a certain flexibility, which is why they will subsequently been described in their rest configuration, i.e. in the absence of any external forces.

The primary branches 10 and the secondary branches 20 extend substantially along the main axis A, and are disposed circumferentially around the main axis A.

In this embodiment, the brush 1 comprises two branch patterns, a primary branch 10 and a secondary branch 20.

The term primary branch 10 should be understood to mean a branch comprising an outer blade 4 and an inner blade 6 forming a loop. The outer blade 4 and the inner blade 6 each have two ends, and each end of the outer blade 4 is connected to one end of the inner blade 6 such that the outer blade 4 and the inner blade 6 form a loop.

The term secondary branch 20 should be understood to mean a branch, the blade or blades of which has or have a free end, such that the secondary branch 20 has no loop. For example, a secondary branch 20 may comprise an outer blade 4 and an inner blade 6, having a free end. A secondary branch 20 may also comprise a single blade.

The primary branch 10 and the secondary branch 20 are therefore differentiated in that the primary branch 10 comprises an outer blade 4 and an inner blade 6 forming a loop, whereas the secondary branch 20 comprises one or more blade(s) but has no loop. The blade (or blades) 4,6 of a branch 10, 20 may be distinct from the blade (or blades) 4,6 of another branch 10,20.

The brush 1 may comprise one or more branches of each pattern.

The branches of one and the same pattern may be identical with one another, i.e. all the primary branches 10 and the blades 4,6 of the primary branches 10 can be of the same dimensions, and all the secondary branches 20 and the blades 4, 6 of the secondary branches 20 can be of the same dimensions.

In this embodiment, the primary branch 10 is circumferentially thicker than the secondary branch 20.

The primary branch 10 and the secondary branch 20 have applicator elements 5 radially protruding toward the outside of the brush 1, in such a way as to be able to come into contact with eyelashes. However, other application elements, for example for eyebrows, hair, nails etc. are also envisioned, as long as suitable applicator elements 5 are chosen.

The applicator elements 5 form one or more rows (here, one or two rows) of applicator elements 5 extending along a primary branch 10 or a secondary branch 20 along the main axis A.

In this embodiment, the brush 1 comprises four primary branches 10 and four secondary branches 20, evenly distributed around the main axis A, the primary branches 10 and the secondary branches 20 being provided alternately.

In particular, the brush 1 of the first embodiment is rotationally invariant by an angle of 90° (and its multiples, particularly 180° and 270°) about the main axis A.

In the examples described and the figures attached, the branches have a symmetrical distribution. It will however be understood that the branches can also have a non-symmetrical distribution and/or be unevenly distributed around the main axis A.

FIG. 4 shows a second embodiment, wherein the density of primary branches 10 and secondary branches 20 is greater than in the first embodiment.

In particular, the brush 1 of the second embodiment comprises six primary branches 10 and six secondary branches 20. In addition, the brush 1 of the second embodiment is rotationally invariant by an angle of 60° (and its multiples, particularly 120°, 180°, 240° and 300°) around the main axis A.

The primary branches 10 and the secondary branches 20 are provided in a plane comprising the main axis A, and in particular a virtual half-plane delimited by the main axis A.

The secondary branch 20 of the first embodiment will be described in FIG. 5 corresponding to a view in the section plane V-V of FIG. 3. The primary branch 10 of the first embodiment will be described in FIGS. 6 and 7 respectively corresponding to views in the section planes VI-VI and VII-VII of FIG. 3.

The views of FIGS. 5 to 10, which will be described below, have a symmetry along the main axis A. Each of these views therefore have two symmetrical branches, and only one of them will be described.

FIG. 5 has a secondary branch 20 with a blade. Similarly to the structure of the primary branches 10, the blade of this secondary branch 20 will be referred to as the outer blade 4. Applicator elements 5 are provided on the brush 1, over a part radially outward of the outer blade 4.

The outer blade 4 is traversed by a virtual half-plane delimited by the main axis A, this virtual half-plane being here included in the section plane V-V which is the plane of FIG. 5.

The outer blade 4 has a convex shape seen in section view in the plane of FIG. 5 and extends along the main axis A between a support, on which the outer blade 4 is mounted, and a free end of the brush 1.

The outer blade 4 has a substantially constant curvature seen in section view in the plane of FIG. 5, with the exception of the ends of the outer blade 4, which have a greater curvature.

FIG. 6 has a primary branch 10 having an outer blade 4 and an inner blade 6.

The outer blade 4 and the inner blade 6 are traversed by one and the same virtual half-plane delimited by the main axis A, here contained in the section plane VI-VI which is the plane of FIG. 6.

The outer blade 4 and the inner blade 6 have two ends meeting to form a closed loop.

The closed loop is here of convex shape. In other words, the outer blade 4 and the inner blade 6 are both of convex shape in section view in one and the same virtual half-plane traversing the outer blade 4 and the inner blade 6, and the outer blade 4 and the inner blade 6 turn their respective concavities toward one another.

The outer blade 4 has a substantially constant curvature in section view in the plane of FIG. 6.

The inner blade 6 has a substantially constant curvature in section view in the plane of FIG. 6.

The curvature of the outer blade 4 is greater than the curvature of the inner blade 6. This allows a greater amplitude of deformation of the outer blade 4 in response to a radial force, which allows the outer blade 4 to adapt to the shape of the eyelashes when applying formula.

The ends at which the outer blade 4 and the inner blade 6 meet are curved. The curvature at the ends is greater than the curvatures of the outer blade 4 and of the inner blade 6 apart from their ends. Where applicable, one and/or the other of the ends can form a ridge.

The inner blade 6 is located at a distance from the main axis A which is strictly positive and less than a distance from the outer blade 4 to the main axis A, excluding application elements 5.

The distance from the inner blade 6 to the main axis A is less than the distance from the outer blade 4 to the main axis A if the median distance to the main axis from the positions of the inner blade 6 is less than the average distance to the main axis A from the positions of the outer blade 4.

In other words, the loop formed by the outer blade 4 and the inner blade 6 is contained in a virtual hollow cylindrical sleeve C centered on the main axis, of inner radius $r_i$ and outer radius $r_e$.

In other words, the outer blade 4 and the inner blade 6 of all the primary 10 and the secondary 20 branches are contained together in an outer cylinder having for axis the main axis A, of outer radius $r_e$, and which is a smaller cylinder including the outer blade 4 and the inner blade 6; while no part of the outer blade 4 or of the inner blade 6 is contained in an inner cylinder having for axis the main axis A, of inner radius $r_i$ and of axial length identical to the axial length of the outer cylinder. The inner cylinder is therefore a cylinder having the main axis A as its axis, of the same axial length as the outer cylinder, and having the widest possible radius without including any other part of the inner blade 4 or of the outer blade 6. The hollow cylindrical sleeve is defined between the outer cylinder and the inner cylinder.

The hollow cylindrical sleeve, the outer cylinder and the inner cylinder are virtual. The term "virtual" is understood to mean an element which does not have any physical medium.

The virtual hollow cylindrical sleeve C denotes the virtual hollow cylindrical sleeve, the so-called "envelope", i.e. the virtual hollow cylindrical sleeve C having values of maximum inner radius $r_i$ and outer radius $r_e$ and minimal axial length such that each of the four faces of the hollow cylindrical sleeve are tangent to the outer blade 4 or to the inner blade 6.

As shown in FIGS. 3 to 6, the blades are all contained at a distance from the main axis A less than the outer radius $r_e$. As shown in FIGS. 5 and 6, no blade part is located at a distance from the main axis A less than the inner radius $r_i$.

It can be seen in FIGS. 3 to 6 that the position of the outer blade 4 of the primary branch 10 of FIG. 6 the furthest from the main axis A is further from the main axis A than the position of the outer blade 4 of the secondary branch 20 of FIG. 5 the furthest from the main axis A, such that the outer cylinder of the hollow cylindrical sleeve is defined for the branch of FIG. 6.

In the same way, but independently, the position of the inner blade 6 of the primary branch 10 of FIG. 6 the closest to the main axis A is closer to the main axis A than the position of the outer blade 4 of the secondary branch 20 of FIG. 5 the closest to the main axis A, such that the inner cylinder of the hollow cylindrical sleeve is defined for the branch of FIG. 6.

The hollow cylindrical sleeve has a thickness $e=r_e-r_i$, between 1 mm and 7 mm, preferably between 2 mm and 5 mm, excluding application elements 5.

The axial length of the hollow cylindrical sleeve is equal to the axial length of the loops, corresponding to the axial length of the inner 6 and outer 4 blades, and is between 10 mm and 45 mm, preferably between 25 mm and 40 mm, preferably equal to 30 mm.

In the examples described and the appended figures, all the primary branches 10 and the secondary branches 20 are tangent to two or more than two faces of the cylindrical sleeve. These primary branches 10 and these secondary branches 20 are distributed all around the main axis A and are such that the outer blades 4 of these primary branches 10 are located at one and the same first distance from the main axis A and the outer blades 4 of these secondary branches 20 are located at one and the same second distance from the main axis A, the second distance here being less than the first distance but being able to be, in other cases, greater than or equal.

In an alternative embodiment, the distribution and dimensions of the primary branches 10 and/or the secondary branches 20 can be variable over a circumference. Moreover, the distance to the main axis from the ends of the primary branches 10 and from the secondary branches 20 may vary from one branch to the other, such that the primary branches 10 and the secondary branches 20 can be disposed over a shape other than a circle.

For example, in the case where the primary branches 10 have a substantially ellipsoidal distribution around the main axis A, i.e. the ends of all or part of the primary branches 10 viewed in a radial plane define an elliptical contour, and the cylindrical sleeve can have an ellipsoidal base. In other words, the inner cylinder and the outer cylinder that define the cylindrical sleeve, and between which all the outer blades 4 and all the inner blades 6 of the primary branches 10 and of the secondary branches 20 are contained, are cylinders with ellipsoidal bases of the same length and such that the base of the inner cylinder is a reduction of the base of the outer cylinder.

In general, it will be understood that the outer cylinder and the inner cylinder can have various shapes centered or not on the main axis A, for example a cylinder shape with any base.

For example, one can define the outer cylinder such that its base is the convex envelope of the outer blades 4 viewed in a radial plane at a position in which the outer blades 4 are the most distant from the main axis A.

More generally, the thickness e can denote the greatest thickness of a branch out of all the branches of the brush, in which the thickness of a branch is the difference between the distance to the main axis from the point of the branch the furthest from the main axis A and the distance to the main axis from the point of the branch the closest to the main axis A.

The branch 10 of the FIG. 7 is the branch 10 of FIG. 6 viewed in an axial section plane containing applicator elements 5.

The branches of FIGS. 8 to 10 are alternatives to the branches of FIGS. 6 and 7, and their common features will not be described.

The section views of FIGS. 6, 8, 10, are views along section planes not including any applicator elements 5, but it will be understood that the branches shown comprise applicator elements 5 outside these section planes.

In the embodiment of FIG. 8, the loop does not have a convex shape, and has a region of concavity.

In particular, in the embodiment of FIG. 8, the outer blade 4 is not of convex shape, and has a region of concavity.

The outer blade 4 has a bulge, i.e. a region in which the distance to the main axis from the outer blade 4 increases in such a way to form at least one inflexion point in the curvature of the outer blade 4. In particular, the outer blade 4 of FIG. 8 has two inflexion points, on either side of the bulge. In addition, the bulge has a greater curvature than the rest of the blade, apart from the ends and inflexion points.

It will be understood that ethers the outer blade 4 can have other shapes, for example flat, concave, or else having an alternation of several bulges and regions of concavity, etc.

The brush of FIG. 9 corresponds to the brush of FIG. 7, also having a reinforcement.

A reinforcement connects at least two distinct inner blades 6. For example, a reinforcement connects two circumferentially opposed inner blades 6 or two circumferentially adjacent inner blades 6.

A reinforcement comprises at least one arm 8 connected on the one hand to an inner blade 6, and on the other hand to several other distinct arm(s) 8, such that the distinct inner blades 6 are connected to one another.

Here a reinforcement is defined by a set of arms 8 connected to one another. It will be understood that a brush can have several reinforcements, each corresponding to a distinct set of arms 8 connected to one another.

Not all the branches are necessarily connected to one another by arms 8. For example, certain branches from among the plurality of branches can be connected to no other branch, and certain branches from among the plurality of branches can be connected to one another by one or more arms 8.

Certain branches can be connected to one another by arms 8 of different kinds. For example, arms 8 of different natures can have different shapes, different sections and/or different orientations. This makes it possible to adjust the flexibility of the branches over a circumference of the brush, and thus allow an application with a force adapted to the orientation of the brush with respect to the eyelashes of the user.

The arms 8 can be connected to branches at variable axial positions. This makes it possible to adjust the flexibility of the branches along the brush, and thus allow an application with a force adapted to the position of the eyelashes of the user along the brush.

All the primary branches 10 and the secondary branches 20 of the brush 1 can be supported by arms 8 forming one and the same reinforcement. It will also be understood that only certain primary branches 10 and secondary branches 20 can have arms 8 forming one and the same reinforcement. For example, a reinforcement can be formed between all the primary branches 10, and another reinforcement can be formed between all the secondary branches 20.

A brush can then have a single reinforcement, several reinforcements at different positions along the main axis A, or not have any reinforcement.

When applying formula to an eyelash, a branch circumferentially opposed to a branch in contact with the eyelash is free. Thus, forces applied to the branch in contact with the eyelash are transmitted to the circumferentially opposite branch via the reinforcement, which makes it possible to stiffen the structure of the brush. Moreover, the formula can be exchanged between two branches by way of the reinforcement, particularly the arms 8.

In this embodiment, the arms 8 meet along the main axis A.

The arms 8 are oblique here, i.e. having a different direction from the radial and axial directions. Two arms 8 meeting obliquely make it possible to form a spring effect making it possible to dampen the forces transmitted to a branch during contact with an eyelash. Alternatively, the arms 8 can be radial.

The branch of FIG. 10 corresponds to the branch of FIG. 8, comprising arms 8.

It will be understood that the primary branches 10 and the secondary branches 20 can have all or part of the features described above.

The brush 1 can also include branches of a third kind, not including any applicator elements 5 and comprising the outer 4 and/or inner 6 blades described above.

From FIGS. 9 and 10 it can be seen that the arms 8 extend over an axial length less than the axial length of the inner blades 6. Thus, despite the presence of arms 8, the concerned branches 10, 20 remain distinct.

This application has been described for embodiments having a primary branch 10 and a secondary branch 20. It will be understood that this description does not presume a relative importance of one branch over the other. Moreover, it will be understood that the brush can also include only primary branches, or else include primary branches as well as secondary branches and/or branches of a third kind.

It will be understood that the definition of the hollow cylindrical sleeve is applicable to a brush 1 having such a diversity of branches, the virtual hollow cylindrical sleeve being the smallest virtual hollow cylindrical sleeve in which all the blades of the brush are contained.

The brush 1 is suitable for manufacturing by a manufacturing process by an additive manufacturing method.

For example, the inner blade 6 and/or the outer blade 4 can be manufactured by additive manufacturing method, for example powder bed fusion, selective laser sintering or multi-jet fusion, for example comprising a polymer material from among polyamides, polyolefins, co-polyesters, styrenic polymers, or silicon. It will however be understood that the brush 1 can be made by any combination of manufacturing processes by additive manufacturing methods and associated material having enough resolution for the production of the brush 1 equipped with applicator elements. Such a brush can then be mounted on a support assembled on a stick.

The invention claimed is:

1. A mascara brush extending along a main axis of a support and comprising at least one branch equipped with applicator elements, wherein the at least one branch comprises a primary branch having an inner blade and an outer blade forming a closed loop, and the inner blade is located at a first distance from the main axis of the support which is non-zero and the outer blade is spaced radially outward from said inner blade at a second distance greater than the first distance to the main axis of the support, wherein a first end of said primary branch is a free end and a second end of said primary branch is connected to said support.

2. The mascara brush as claimed in claim 1, wherein applicator elements are disposed on the outer blade of the primary branch.

3. The mascara brush as claimed in claim 1, wherein the inner blade and the outer blade are traversed by one and the same virtual half-plane delimited by the main axis.

4. The mascara brush as claimed in claim 1, wherein the loop of the primary branch is contained in a virtual hollow cylindrical sleeve centered on the main axis and of a thickness between 1 and 7 mm.

5. The mascara brush as claimed in claim 1, wherein the primary branch has a convex oblong shape viewed in a circumferential projection.

6. The mascara brush as claimed in claim 1, wherein the primary branch has an oblong shape having at least one inflexion point viewed in a circumferential projection.

7. The mascara brush as claimed in claim 1, wherein the at least one branch comprises a plurality of branches distributed around the main axis.

8. The mascara brush as claimed in claim 7, wherein the plurality of branches are identical or wherein the plurality of branches are evenly distributed around the main axis or wherein the plurality of branches are both identical and evenly distributed around the main axis.

9. The mascara brush as claimed in claim 7, wherein successive branches of the plurality of branches are of different shapes.

10. The mascara brush as claimed in claim 7, wherein the plurality of branches are primary branches having alternately a convex oblong shape viewed in a circumferential projection and an oblong shape having at least one point of inflexion viewed in a circumferential projection.

11. The mascara brush as claimed in claim 7, having at least one reinforcement connecting at least two distinct inner blades.

12. The mascara brush as claimed in claim 11, wherein the at least one reinforcement extends in a direction which is oblique with respect to the main axis.

13. The mascara brush as claimed in claim 11, wherein the reinforcement comprises a plurality of arms respectively connected to the inner blades of the plurality of branches.

14. The mascara brush as claimed in claim 11, wherein the reinforcement comprises a plurality of arms respectively connected to the inner blades of the plurality of branches meeting along the main axis.

15. The mascara brush as claimed in claim 1, wherein the loop of the primary branch is contained in a virtual hollow cylindrical sleeve centered on the main axis and of a thickness between 2 mm and 5 mm.

16. A process for manufacturing a mascara brush, extending along a main axis of a support and comprising at least one branch equipped with applicator elements, wherein the at least one branch comprises a primary branch having an inner blade and an outer blade forming a closed loop, and the inner blade is located at a first distance from the main axis of the support which is non-zero and the outer blade is spaced radially outward from said inner blade at a second distance greater than the first distance to the main axis of the support, wherein a first end of said primary branch is a free end and a second end of said primary branch is connected to said support, comprising at least one step of manufacturing at least one of an inner blade and an outer blade by an additive manufacturing method.

17. A mascara applicator comprising a brush as claimed in claim 1, wherein the support is connected to the brush and configured to be assembled on a stick.

* * * * *